US005591328A

United States Patent [19]

Bodnaras

[11] Patent Number: 5,591,328

[45] Date of Patent: Jan. 7, 1997

[54] GAS PARTICLE FORMATION

[75] Inventor: George Bodnaras, Western Australia, Australia

[73] Assignee: Atomaer Pty. Ltd., Perth, Australia

[21] Appl. No.: 64,108

[22] PCT Filed: Nov. 25, 1991

[86] PCT No.: PCT/AU91/00546

§ 371 Date: May 24, 1993

§ 102(e) Date: May 24, 1993

[87] PCT Pub. No.: WO92/09360

PCT Pub. Date: Jun. 11, 1992

[30] Foreign Application Priority Data

Nov. 23, 1990 [AU] Australia ..... PK3534

[51] Int. Cl.[6] ..... B03D 1/24; B01F 3/04

[52] U.S. Cl. ..... 209/170; 210/221.2; 210/220; 261/76; 261/123

[58] Field of Search ..... 209/170, 164; 210/221.2, 221.1, 220; 261/122.1, 123, 124, 76, DIG. 75

[56] References Cited

U.S. PATENT DOCUMENTS

| | | | |
|---|---|---|---|
| 2,202,484 | 5/1940 | Emery | 209/170 |
| 2,616,676 | 11/1952 | Walker . | |
| 2,695,710 | 11/1954 | Gibbs . | |
| 2,922,521 | 1/1960 | Schranz . | |
| 2,938,629 | 5/1960 | Hollingsworth . | |
| 3,012,669 | 12/1961 | Ziemer . | |
| 3,012,671 | 12/1961 | Ziemer . | |
| 3,012,672 | 12/1961 | Ziemer . | |
| 3,256,802 | 6/1966 | Karr . | |
| 3,263,966 | 8/1966 | Breer . | |
| 3,339,730 | 9/1967 | Boutin . | |
| 3,545,731 | 12/1970 | McManus . | |
| 3,630,498 | 12/1971 | Bielnski . | |
| 3,693,886 | 9/1972 | Conrad | 239/432 |
| 3,704,008 | 11/1972 | Ziegler . | |
| 3,780,198 | 12/1973 | Pahl . | |
| 3,829,070 | 8/1974 | Reba . | |
| 3,927,152 | 12/1975 | Kyrias . | |
| 3,954,922 | 5/1976 | Walker . | |
| 4,117,048 | 9/1978 | Stockner . | |
| 4,186,094 | 1/1980 | Hellberg . | |
| 4,193,950 | 3/1980 | Stockner . | |
| 4,208,276 | 6/1980 | Bahr | 209/168 |
| 4,210,534 | 7/1980 | Molvar | 210/220 |
| 4,272,461 | 6/1981 | Franklin, Jr. | 261/93 |
| 4,347,128 | 8/1982 | Barnscheidt . | |
| 4,456,528 | 6/1984 | Akimoto . | |
| 4,534,862 | 8/1985 | Zlokarnik . | |
| 4,560,474 | 12/1985 | Holik . | |
| 4,620,926 | 11/1986 | Linck . | |
| 4,643,852 | 2/1987 | Koslow . | |
| 4,682,991 | 7/1987 | Grethe et al. . | |
| 4,708,829 | 11/1987 | Bylehn . | |
| 4,717,515 | 1/1988 | Forsyth . | |
| 4,790,944 | 12/1988 | Gordon . | |
| 4,842,777 | 6/1989 | Lamont . | |
| 4,861,165 | 8/1989 | Fredriksson . | |
| 4,917,152 | 4/1990 | Decker . | |
| 5,021,165 | 6/1991 | Kalnins . | |

FOREIGN PATENT DOCUMENTS

| | | |
|---|---|---|
| 0165228 | 12/1985 | European Pat. Off. . |
| 0190688 | 8/1986 | European Pat. Off. . |
| 325976 | 1/1989 | European Pat. Off. . |
| 765713 | 6/1934 | France . |
| 1181944 | 6/1959 | France . |
| 2459677 | 1/1981 | France . |
| 2594713 | 2/1986 | France . |
| 1245910 | 8/1967 | Germany . |
| 3529638 | 7/1986 | Germany . |
| 61-282492 | 12/1986 | Japan . |
| 1512565 | 6/1978 | United Kingdom . |
| 87/00078 | 1/1987 | WIPO . |

*Primary Examiner*—Thomas M. Lithgow
*Attorney, Agent, or Firm*—Michael, Best & Friedrich

[57] ABSTRACT

A method of gas particle formation in a liquid medium comprising the steps of: forming a substantially continuous film of gas on a surface having a discharge edge submerged in the liquid medium; generating a flow of liquid over the surface, adjacent to and co-current with the film of gas, directed towards the discharge edge; and breaking the gas film into gas particles by shear forces as it approaches and/or escapes from the discharge edge.

14 Claims, 5 Drawing Sheets

GAS PARTICLE FORMATION

The present invention relates no a method and apparatus for gas particle formation in liquid media and relates particularly, though not exclusively, to aeration of a liquid/slurry in flotation apparatus.

BACKGROUND TO THE INVENTION

The method and apparatus for gas particle formation according to the invention can be used in any application requiring efficient aeration of liquid media such as, for example, aeration/oxygenation for biological waste liquid purification using aerobic micro-organisms, liquid/slurry preaeration and/or combined shear flocculation, liquid gasification and suspension of minerals or coal enrichment. The following description will be given with particular reference to gas particle formation and dispersion in a liquid/slurry in mineral flotation apparatus, however it will be appreciated that the inventive method and apparatus has much wider applications.

Froth flotation is a process used for concentrating values from low-grade ores. After/during fine grinding the ore is mixed with water to form a slurry. Chemicals are added to the slurry to preferentially develop differences in surface characteristics between the various mineral species present. The slurry is then copiously aerated and the preferred (hydrophobic) mineral species cling to bubbles and float as a mineralised froth which is removed for further processing.

It is well established that a key factor in the performance of the flotation technique is the size, volume and distribution of gas particles or air bubbles that can be dispersed into the slurry. The present invention was developed with a view to providing a method and apparatus for gas particle formation in which the desired size of gas particles can be readily controlled and a relatively uniform distribution of gas particles can be achieved irrespective of the gas flow rates required by the process. Several further improvements to flotation apparatus are also described.

SUMMARY OF THE INVENTION

According to one aspect of the present invention there is provided a method of gas particle formation in a liquid medium comprising the steps of:

forming a film of gas on a surface having an edge submerged in said liquid medium;

generating a flow of liquid over said surface, adjacent said film of gas, directed towards said edge;

whereby, in use, the gas film is broken into gas particles by shear forces as it approaches and/or escapes from said edge.

Preferably the method further comprises generating a second flow of liquid which converges with the first mentioned flow at said edge.

Typically the first and second liquid flows have dissimilar velocities and are typically accelerated towards the edge of the surface together with the gas film.

According to another aspect of the present invention there is provided an apparatus for gas particle formation, the apparatus comprising:

a structure having a surface adapted to form thereon a film of gas supplied thereto when submerged in a liquid medium; said surface having an edge arranged so that, in use, a flow of liquid generated over said surface, adjacent said film of gas, and directed towards said edge results in the gas film being broken into gas particles by shear forces as it approaches and/or escapes from said edge.

Preferably said edge is in the form of a lip whereby, in use, said flow of liquid over said surface can converge with a second flow of liquid at said lip.

In one embodiment of the apparatus said structure comprises a cylindrical body having a circumferential edge flared outwardly defining an annular lip at one end, an outer surface of said body being adapted to form said film of gas thereon. Preferably said body is housed in a chamber having a liquid inlet and having an outlet in the form of a circular aperture with an inner escape diameter slightly larger than an outer diameter of said annular lip.

In an alternative embodiment said structure comprises first and second hollow bodies mounted concentrically within a chamber such that outer circumferential edges of the bodies form at least one annular gap through which liquid and gas can escape. Preferably an outer surface of at least one of said hollow bodies is adapted to form said film of gas thereon. Preferably the chamber is provided with a cylindrical wall having a peripheral edge that forms an annular gap with an outer circumferential edge of one of the bodies.

In another embodiment of the apparatus for gas particle formation said structure comprises a coniform body having an outer circumferential surface that tapers in a curved manner, and which is adapted to form thereon a film of gas when submerged in a liquid medium. The outer surface is preferably provided with at least one circumferential ridge forming an edge of the surface.

In a more preferred embodiment said prefilming body is housed in said chamber having an outlet in the form of a circular aperture, said body being located with said annular lip proximate the circular aperture to form an annular gap.

The prefilming body is advantageously is provided with gas distribution outlets for delivering gas onto said outer surface on which, in use, said film of gas is formed, said distribution outlets being covered by a self-sealing resilient material.

According to another aspect of the present invention there is provided a flotation apparatus incorporating the above-mentioned gas particle formation apparatus therein, for aerating a liquid/slurry contained therein.

Preferably the flotation apparatus is in the form of a flotation column and said gas particle formation apparatus is located at, or in the vicinity of, a lower end of the column.

BRIEF DESCRIPTION OF THE DRAWINGS

In order that the nature of the present invention may be more clearly ascertained preferred embodiments will now be described in detail, by way of example only, with reference to the accompanying drawings, in which.

DETAILED DESCRIPTION OF PREFERRED EMBODIMENTS

Figure 1:
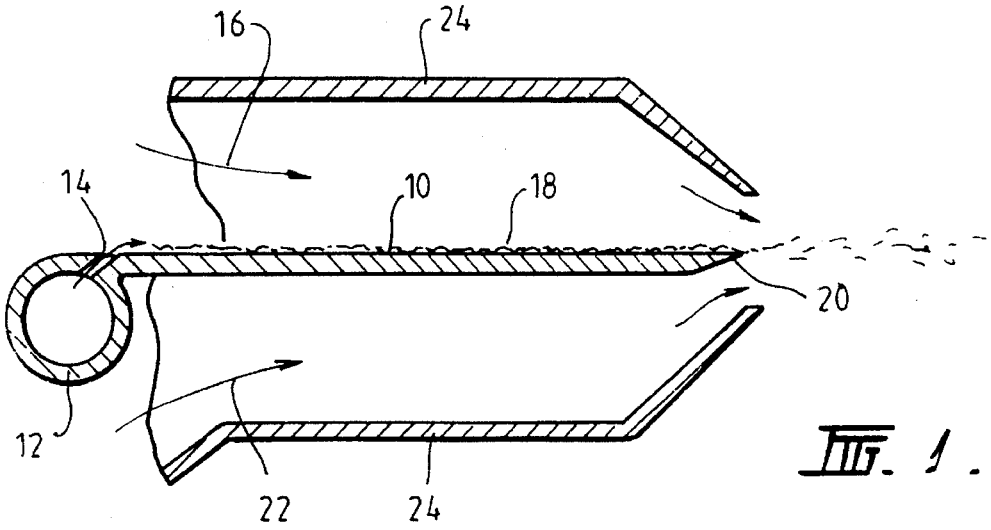
FIG. 1 illustrates schematically one form of gas particle formation apparatus.

A novel method of gas particle formation in a liquid media, as may be employed in the preferred embodiments of the present invention, will now be described with reference to FIG. 1. The method employs the principle of gas prefilming as illustrated in FIG. 1 on surface 10 which may be planar, circular, or conical as required. The structure illustrated in FIG. 1 in section view is partially or completely submerged in liquid media. A supply of gas through conduit 12 feeds onto the surface 10 via gas port 14, and due to the flow of liquid 16 over the surface 10 tends to form a thin film 18 on the latter. Surface 10 is provided with an edge 20 in the form of a lip towards which the flow of liquid 16, adjacent the gas film 18, flows over the surface 10. As the film of gas 18 escapes from the edge 20 of the surface 10 it is broken into gas particles by shear forces generated by the transfer of momentum between the liquid 16 and gas film 18.

Preferably a second flow of liquid 22 is generated which converges with the first flow 16 at the lip 20 of surface 10. The convergence of the concurrent liquid flows 16, 22 enhances the shear forces generated between the gas film 18 and the liquid media as the gas film escapes from the lip 20 and subsequently mixes with the two streams of liquid. Typically the two streams of liquid 16, 22 have more dissimilar velocities and are accelerated towards the lip 20 together with the gas film 18. For this purpose baffles 24 are provided in the illustrated arrangement for regulating the passage of liquid 16 and 22 towards the lip 20. If the accelerating flow is also subjected to a continuous change in direction away from the gas prefilming surface 10 the liquid flow may break up the gas film into particles before lip 20 is reached.

It is by no means essential to have two liquid flows, and a single liquid flow 16 would also operate successfully. In this alternative arrangement the mass of liquid below the surface 10 would initially be substantially stationary, however as the gas film 18 and liquid 16 escape from the surface 10 at lip 20 liquid 22 below the surface 10 would be entrained with the stream of liquid and gas particles escaping from the lip 20. Typically the gas film 18 has a higher velocity than the liquid flows 16 and 22.

The size of the gas particles or bubbles formed before or at the lip 20 is largely determined by the relative velocities and qualities of the liquid flows 16 and 22 and the gas film 18. A typical mean bubble size of 0.5 mm can be achieved with liquid flow velocities of approximately 6 meters per second at a pressure drop in the range of 20–60 kPa, for a given device configuration. Gas particle sizes of between 50 micrometers to 2–3 mm can be achieved by varying the relative velocities of the liquid and gas. However, for constant liquid and gas velocity profiles the volume and distribution of gas particles produced by the illustrated method and structure remain substantially uniform.

Four different embodiments of a gas particle formation apparatus or aeration device will now be described with reference to FIGS. 2, 3, 4 and 5.

Figure 2A:
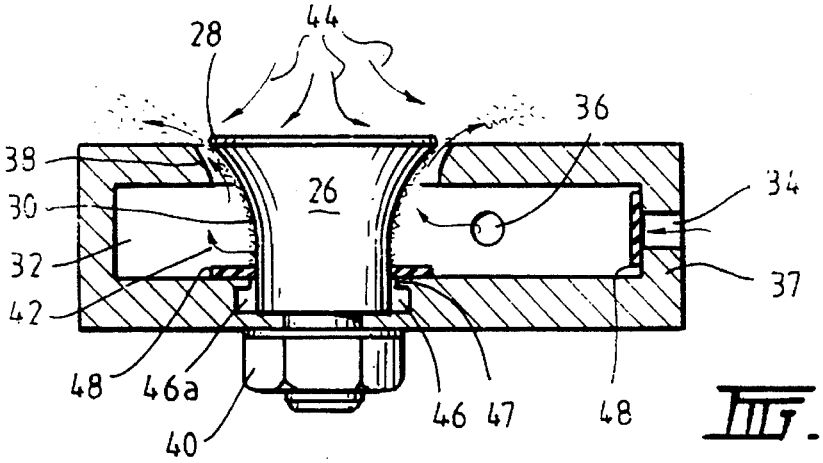
FIG. 2A and B illustrate a preferred embodiment of an aeration unit shown in part section and plan view respectively.
Figure 2B:
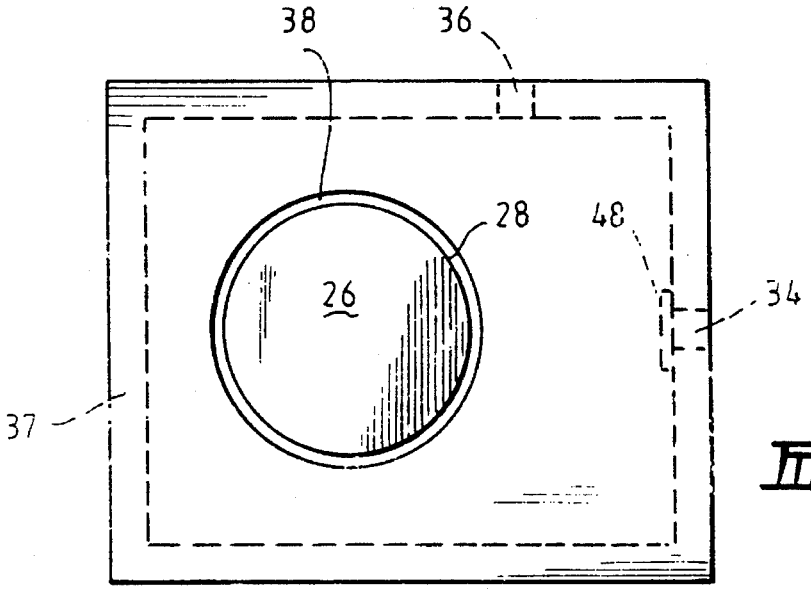

One preferred form of gas dispersion unit or aeration device, illustrated in FIG. 2, comprises a cylindrical body 26 having a circumferential edge flared outwardly defining an annular lip 28. The outer surface 30 of the body 26 is adapted to form a thin film of gas thereon. The gas prefilming body 26 is housed within a chamber 32 having a gas inlet 34 and a liquid inlet 36 provided in the walls 37 thereof. The walls 37 of cheer 32 are also provided with an outlet in the form of a circular aperture with an outer escape diameter slightly larger than an outer diameter of the annular lip 28. The gas prefilming body 26 is mounted in the chamber 32 with the outwardly flared edge received in the circular aperture so that an annular gap 38 is formed between the lip 28 and the inner circumference of the circular aperture. In this embodiment the body 26 is adjustable by means of nut 40 so that the width of the gap 38 can be varied as required.

Liquid enters the cheer 32 via inlet 36 in a tangential manner creating a swirling effect around the stem of the body 26. Gas entering inlet 34, being lighter, is forced to concentrate around the outer surface 30 of the body 26 due to centrifugal forces such that the liquid flow ensuing through the gap 38 forces the gas stream to form a thin film on the outer surface 30. Both liquid and gas are forced through the gap 38 and as the gas film escapes from the lip 28 of the body 26 it is broken into gas particles which subsequently mix with both the prefilming liquid flow 42 and the ejected or shearing flow 44.

Gas may also be injected into the chamber 32 onto the outer surface 30 of the body 26 in an annular or plan fashion through scroll 46, **46*a*. With this alternative method of gas injection it is not necessary for the liquid to enter the chamber in a tangential manner to create the swirling effect, since the gas can be injected directly onto the outer surface 30 of the body 26. In the latter method employed to feed the gas onto the outer surface 30 of the body 26, the gas entry port 47 is covered with resilient or elastic material 48 serving the double function of providing a non-return seal and also enhancing the prefilming effect. In the former method the elastic material 48 provides a non-return seal over gas inlet 34. The position of gas prefilming body 26** can be adjusted manually or automatically for the purpose of obtaining constant or variable gas particle sizes at various liquid/gas ratios and pressures, thereby maintaining a liquid pressure drop between inlet and device discharge within such limits as to obtain the desired gas particle size and subsequent mixing/turbulence parameters.

Figure 3:
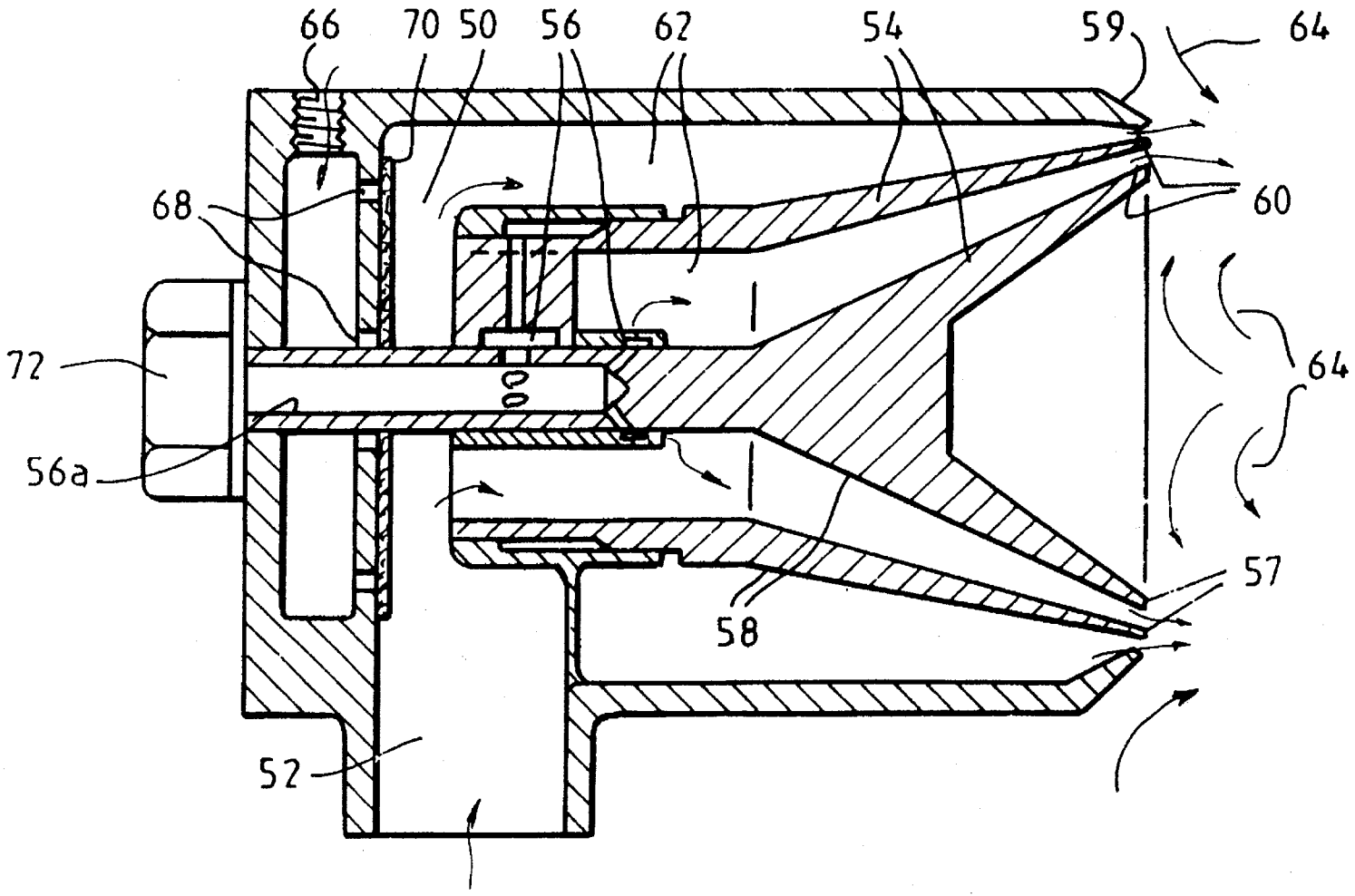
FIG. 3 illustrates in section view another embodiment of an aeration device.

In the second embodiment of a gas dispersion unit illustrated in FIG. 3, liquid enters a chamber 50 also in a tangential manner from liquid inlet 52. Housed within the chamber 50 are a pair of concentrically mounted, hollow frusto-conical bodies 54. Gas inlets 56, **56*a* inject gas into the chamber 50 directly onto the outer surfaces 58 of the gas prefilming bodies 54 in a region of decreasing static pressure gradient. As in the previous embodiment, the gas is forced to concentrate around the outer surfaces 58 of the bodies 54 due to centrifugal forces such that the liquid flow through spaces 62 and further ensuing through the gaps 60 forces the gas stream to form thin films on the outer surfaces 58 of the bodies 54. The hollow bodies 54 are mounted concentrically within the chamber 50 such that the outer circumferential escape edges or lips 57 of bodies 54, together With a peripheral escape edge of the cylindrical wall 59 of chamber 50, form annular gaps 60 through which the liquid and gas can escape from the gas dispersion unit in a specified manner and with the required velocity profile. The gas films formed on the outer surfaces 58 of the bodies 54 are broken into gas particles as they escape from the lips 57, subsequently mixing with both the prefilming liquid flow 62 and the shearing flow 64. Obviously, gas may be fed to either one or both surfaces 58 of the hollow bodies 54**.

In the case where liquid enters through inlet 52 in a tangential manner, gas can also be injected directly into the liquid stream in chamber 50 through alternate gas inlet 66. As with the previous embodiment, the gas entry ports 68 may be covered with elastic material 70 which serves the double function of providing a non-return seal and enhancing the prefilming effect. The size of the gaps 60 may be varied by adjusting the position of the bodies 54 within chamber 50 using nut 72. Hence, as with the previous embodiment the desired gas particle size and subsequent mixing/turbulence parameters can be controlled at various liquids/gas ratios by adjusting the relative positions of the frusto-conical bodies 54 and the walls 59 of chamber 50 either manually or automatically.

Although, as described above, the gas dispersion unit illustrated in section view in FIG. 3 is of circular or cylindrical configuration, FIG. 3 with minor modifications can also represent a section view through a gas dispersion unit of linear or planar configuration. In this alternative arrangement the walls 59 of chamber 50 would be substantially planar extending perpendicularly out of the page, and the bodies 54 would be in the form of planar blades or vanes also extending perpendicularly out of the page. Prefilming of the surfaces 58 of the bodies 54 would not be due to the swirl effect created by tangential liquid flow, but rather due to gas injection directly onto the surfaces 58 through gas inlets 56 and gas ports 68, with the elastic material 70 providing enhanced prefilming. Obviously one or more bodies 54 may be employed to form gaps 60 with the walls 59 of chamber 50 or with adjacent bodies. A plurality of prefilming bodies 54 has the advantage of providing increased gas prefilming surface area and greater control flexibility.

A prefilming body of circular or cylindrical configuration having a circumferential edge flared outwardly in the general direction of the flow is particularly advantageous because the prefilming surface thus formed is of increasing circumferential surface area. Thus the gas film becomes thinner as it flows towards the outwardly flared edge, further enhancing the prefilming effect.

Figure 7:
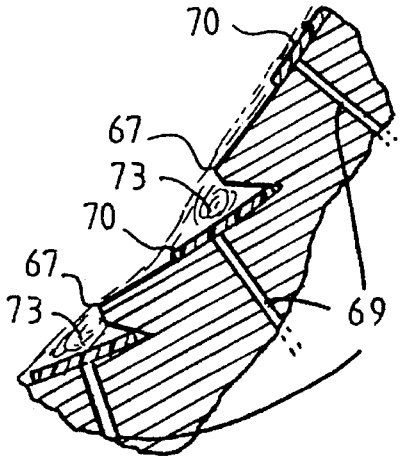
FIG. 7 illustrates a portion of the aeration device shown in FIG. 4.
Figure 4:
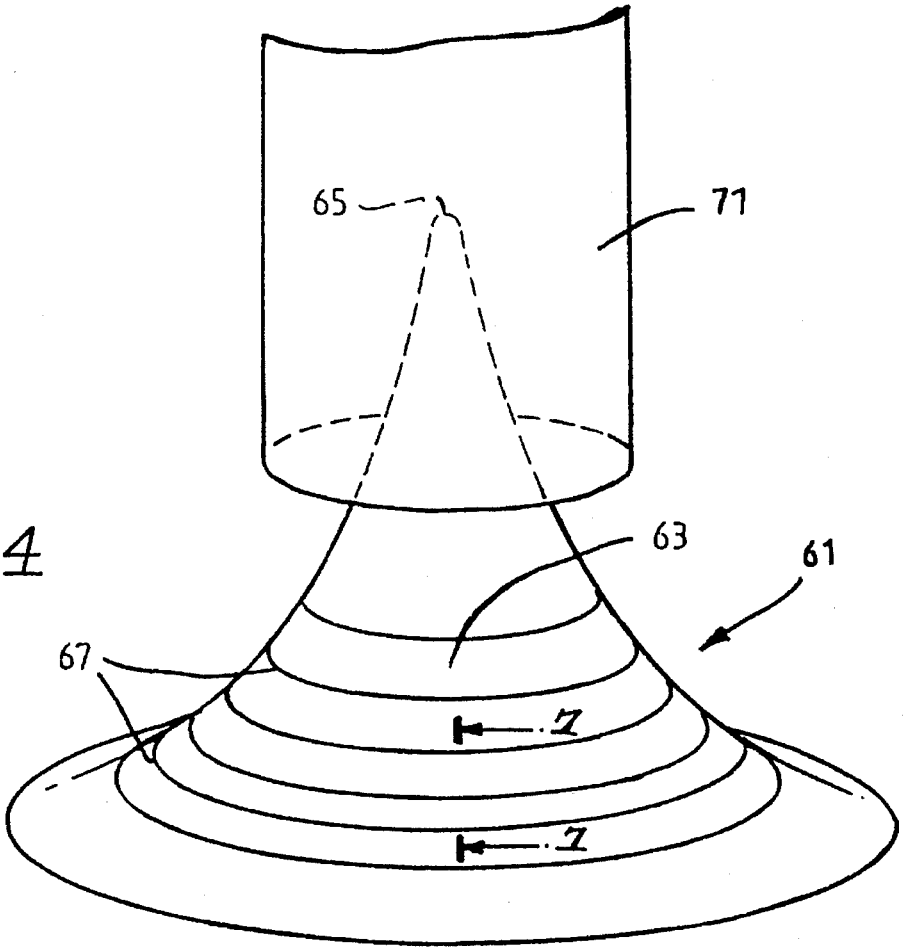
FIG. 4 illustrates yet another embodiment of an aeration device.

FIG. 4 illustrates a third embodiment of a gas dispersion unit or gas particle formation apparatus. This embodiment comprises a gas prefilming body 61 of coniform configuration in which an outer circumferential surface 63 tapers in a curved manner to a point 65. The outer surface 63 is provided with at least one circumferential ridge 67 forming an edge or lip of the surface whereby, in use, a film of gas formed on the surface 63 can be broken into gas particles as it escapes from the lip 67, by shear forces generated between the gas film and an adjacent flow of liquid directed toward said edge. Preferably the outer surface 63 is provided with a plurality of circumferential ridges 67, as can be seen more clearly in the enlargement in FIG. 7, the ridges being formed by a plurality of outer surface portions 63 arranged in a cascade as shown. Gas is directed onto the surface portions 63 via inlets 69 which are covered with resilient or elastic material 70, as in the previous embodiments, which serves to enhance the prefilming effect and provide a non-return seal.

The whole prefilming body 61 is typically submerged in a liquid medium, for example a liquid/slurry, and pointed towards the mouth of liquid feed pipe 71, through which liquid is pumped. The liquid escaping from pipe 71 is fed onto the outer surface 63 of the body 61, and flows over the surface portions 63 in a cascade fashion. Due to the curvature of the outer surface 63 centrifugal forces cause the flow of liquid to exert a pressure on the film of gas formed on each surface portion 63, which in turn produces an acceleration of the gas film towards the lip 67. As the gas film escapes from lip 67 shear forces produced by a transfer of momentum between the gas film and the flow of liquid cause the gas film to be broken into gas particles which, being lighter, tend to be pushed away from the surface 63 to be dispersed into the surrounding liquid media to provide aeration.

Immediately below each ridge or lip 67 a vortex 73 is created which provides a second recirculating flow of liquid which converges with the above described flow at or near the lip 67, to enhance the shearing effect. The above described embodiment is particularly advantageous since it does not require any additional chamber or baffles surrounding the prefilming body 61, in order to generate a suitable flow of liquid over the outer surface 63.

Figure 5:
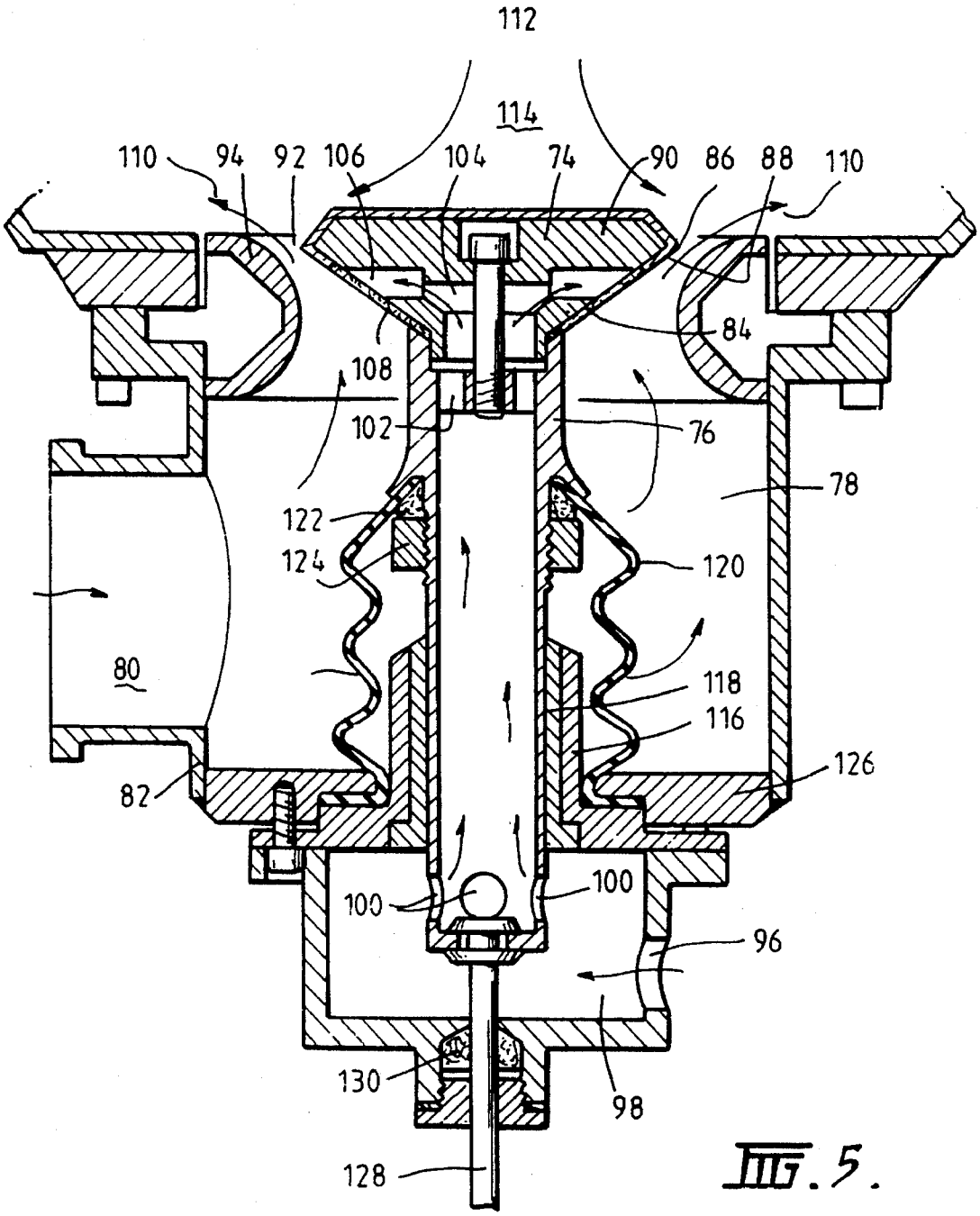
FIG. 5 illustrates a still further embodiment of an aeration device.

FIG. 5 illustrates a still further embodiment of an aeration device according to the present invention, in which a circular prefilming body 74, in the form of an adjustable hollow stem 76, is housed within a liquid chamber 78 having a liquid inlet 80 provided in the wall of the casing 82 thereof. The stem 76 has a head 90 provided with an outwardly flared frusto-conical surface 84 having a circumferential edge defining an annular lip 86 thereon. A portion 88 of the frusto-conical surface 84 is adapted to form a thin film of gas thereon. The casing 82 of the liquid cheer 78 is also provided with a liquid outlet in the form of a circular aperture with an outer escape diameter slightly larger than an outer diameter of the annular lip 86. The adjustable stem 76 is slidably mounted in the casing 82 with the frusto-conical surface 84 of the head 90 received in the circular aperture so that an annular gap 92 is formed between the surface 84 and a convex annular lip 94 of the circular aperture forming the liquid outlet in the casing 82.

In use, gas enters inlet 96 of gas chamber 98, passes through apertures 100 into the hollow stem 76. The gas rises through the hollow stem 76 and passes through apertures 102 into a cheer 104 within the head 90 of the prefilming body 74. The gas is then delivered through distribution outlets 106 onto the prefilming surface portion 88 of the frusto-conical surface 84. The distribution outlets 106 are covered by a self-sealing resilient or elastic spreader 108, typically in the form of an annular rubber washer, which serves the double function of providing a non-return seal and also enhancing the prefilming effect. In use, both liquid/slurry and gas are forced through the gap 92 and as the gas film escapes from the lip 86 it is broken into gas particles which subsequently mix with both the prefilming liquid flow 110 and the recirculating or shearing flow from volume 114 above the head 90. The difference in flow velocity between the slurry and the gas film creates wavelets at the liquid/gas interface in gap 92, and the curvature of convex lip 94 continuously changes the direction of the flow generating centrifugal forces that produce migration of solid particles present in the slurry away from the lip 94. The migrating solid particles then penetrate the gas film and strike the prefilming surface portion 88 on head 90 as well as passing through the broken-up gas film after it escapes into the volume 114 of gas/slurry mixture above the head 90. Hence, each solid particle that passes through the gas film and rejoins the slurry flow in volume 114 will entrain a gas particle thereby producing the required gas dispersion and bubble size enhancing the shearing effect. Both the convex lip 94 and the prefilming surface portion of the head 90 are coated with an abrasion resistant coating, for example, a ceramic coating.

The slurry pressure differential between chamber 78 and volume 114 can be adjusted between 10 kPa and 100 kPa by varying the height of stem 76 guided by a sliding assembly formed by a guide 116, which may be provided with a removable sleeve 118 to form an air tight seal between the stem 76 and guide 116. This arrangement is protected from slurry ingress by a flexible bellows 120 held at one end by a compression washer 122 and nut 124 on stem 76, and at the other end by a flange, provided on guide 116, and a bottom plate 126 of the casing 82. The actuating mechanism for positioning the stem 76 (not illustrated) can be manual or automatic, and is protected from slurry ingress into gas cheer 98 through the hollow stem 76 by the self-sealing spreader 108 made of resilient material. The self centering rod 128 protrudes from chamber 98 through gland 130. The air feed pressure in chamber 98 is typically equal or slightly above the slurry pressure in chamber 78.

In this embodiment of the aeration device, the bubble size can be controlled by varying the gap 92 as a function of the proportion of solids in the slurry between operational values of, for example, 0 and 75%. The pressure differential between cheer 78 and volume 114 can be varied such that bubble sizes in the dimensional range of between 0.2 to 3.0 mm can be obtained for slurry velocities in the gap 92 of between 1.5 and 12 meters per second and gas velocities in the gas film formed on surface 88 of up to 340 meters per second. The resulting swarm of gas particles or bubbles mixes uniformly with the ensuing slurry flow from gap 92 and the recirculating flow 112 from the volume 114 of slurry/gas mixture such that the ratio between the dispersed gas volume and the slurry passing through the device can be as high as 6:1.

The embodiment of the gas dispersion device illustrated in FIG. 5 is provided with only one prefilming body 74. However, in order to increase the prefilming surface area an additional prefilming body (or bodies) may be provided in the form of an annulus concentric with the prefilming body 74.

The above described gas dispersion units can be used in conjunction with flotation apparatus for mineral or coal enrichment processes to achieve enhanced performance with minimum energy consumption. A flotation apparatus which employs a gas dispersion unit similar to that described above will now be described.

Figure 6:
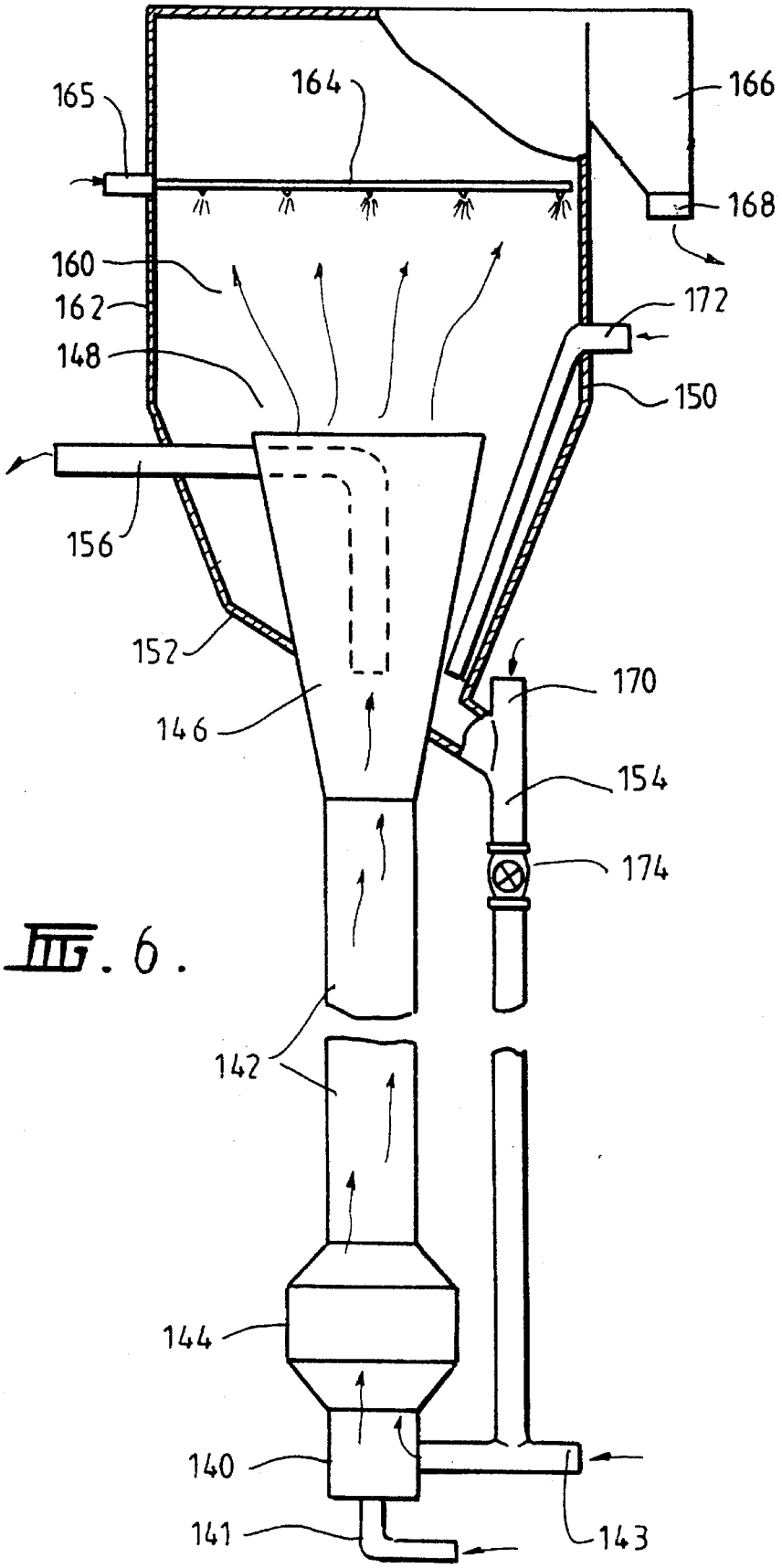
FIG. 6 illustrates a flotation apparatus incorporating the aeration device of FIG. 5.

The flotation apparatus illustrated in FIG. 6 employs a gas dispersion unit or aerator 140, similar to than illustrated in FIG. 5, at the lower end of an elongate riser 142. Gas is injected into the aeration unit 140 through gas inlet 141 and slurry is fed to the unit 140 through slurry feed pipe 143. Riser 142 may be constructed from a variety of materials including high density polypropylene (HDP) pipe sections joined end to end up to a length of 30 meters. Between the riser 142 and gas dispersion unit 140 there is provided a reactor vessel 144 of larger diameter than the riser 142. The reactor vessel 144 is typically manufactured of heavy gauge mild steel sheet with a ceramic coating on the inside. The aeration unit 140 discharges into the reactor producing high shear velocities of up to 10.0 meters per second. The gas bubbles with entrained particles escape from the aeration unit 140 typically in a radial direction and are dispersed uniformly throughout the slurry/gas mixture in reactor 144. Reactor 144 is sized and shaped to facilitate uniform dispersion but to prevent recombination of the gas particles to form larger bubbles, such that most of the flow kinetic energy is dissipated within its volume. The reactor 144 is thus normally the only part of the flotation apparatus where intense turbulence is present, the rest of the flows within the unit being predominantly quiescent.

The gas/slurry mixture rises up through the riser 142 and through a flared end section 146 at the top of the riser, in such a way that when the gas/slurry mixture escapes into the volume 148 of the separation unit 150 it slows down sufficiently for the gas bubbles to separate from the slurry liquid at the discharge mouth of the riser 142. The unattached slurry liquid separates from the froth and drains into the outer vessel 152 from which it can be either recirculated back into the aeration unit 140 as non-aerated pulp through recirculation line 154 or removed as tailings through line 156.

The flow of gas/slurry mixture in the riser 142 is typically turbulence-free or laminar flow and provides the necessary conditions for efficient mineral collection. Bubbly flow conditions are maintained at all times with an air life figure of up to 85%, more typically between 50 to 70%. The velocity of the gas/slurry mixture in the riser 142 is maintained within the range 0.1–2.0 meters per second, more typically between 0.3–1.0 meters per second. Due to the low discharge pressure "seen" by the aeration unit 140, as a direct result of such high air lift values, coupled with the full slurry column pressure at the liquid inlet of the aeration unit, sufficient pressure drop is produced to generate the gas bubble dispersion and recirculation of the slurry through the flotation apparatus, thereby using the gas energy to drive the whole process. The mouth of the outer vessel 152 is sufficiently large relative to the mouth of the riser 142 so that the non-aerated slurry velocity is kept low enough to prevent re-entrainment of gas into the recirculation circuit or tailings discharge.

The pulp level within the outer vessel 152 is maintained below the discharge mouth of the riser 142 by a weir arrangement formed by the tailings outlet line 156. The atmospheric discharge of the tailings line 156 is so positioned that the recombined pulp level in the outer vessel 152 is never above the mouth of the flared end section 146 of the riser 142, and typically 0.05 to 0.25 meters below, such that the riser bottom pressure is not increased by pulp reingestion which could generate turbulence, and recirculation is avoided in the riser.

The froth discharged from the riser forms a deep froth layer 160 rising through a parallel duct 162 connected to a top flange of the outer vessel 152. The froth duct 162 may be partitioned vertically to prevent froth macro recirculation which could result in substantial loss of values. Froth height can be varied by removing one or more sections which form the froth duct 162 or by having froth duct of variable height.

Above the froth duct 162 is a froth wash system 164 in which the froth is washed by a dispersed flow of water mixed with additives from a manifold fed through port 165. The froth wash system 164 may be combined with a froth removal system 166 which collects the final concentrate to drain from outlet 168 for storage and/or further processing.

The slurry pressure drop can be varied by increasing/decreasing the prefilming gap in the aeration unit 140, thereby controlling the bubble size at the same time as the recirculation rate. The flotation unit is typically sized such that the volume of slurry recirculated is 4 to 20 times the likely slurry feed flow, which is a significant advantage over the current practice of "single pass", thereby improving the values attachment probability and therefore improved recovery of slow floting values. Furthermore, as the slurry flow rate through the aerator is dictated solely by the operating pressure drop its value is not affected by variations in feed flow since the recirculated flow of slurry varies to compensate, thereby maintaining unchanged gas dispersion characteristics. An added advantage resulting from the abovementioned features is that the flotation apparatus exhibits typically short residense times, for example between 30–120 seconds.

An alternative feed method for the pulp is to use feed inlets 170 at the top of the recirculation line 154, and/or to use feed pipe 172 feeding directly into the vessel 152. Feed pipe 172 can be used provided the feed discharge into the top of the recirculation line 154 is totally decoupled from the entry to the tailings outlet line 156. The recirculation line 154 can be provided with a control valve 174 to control the flow of slurry fed to the aeration unit 140.

The flotation apparatus of FIG. 6 employs only one aeration unit 140, however two or more aeration units could be coupled to the riser 142 if desired. Each unit would typically be provided with its own reactor vessel for gas dispersion. One or more risers can be incorporated in a flotation apparatus if desired. Furthermore, the basic principle of having an aeration unit with reactor and riser could be employed with a conventional flotation column by having the riser located adjacent the column with concentrated slurry from the column's quiescent zone just under the pulp/froth interface being recirculated therethrough. The riser could also be located within the column of a conventional flotation apparatus suitably modified.

Now that preferred embodiments of the gas particle formation method and apparatus, and various improvements to flotation apparatus, have been described in detail, it will be apparent to those skilled in the relevant arts that numerous variations and modifications may be made to the described embodiments, other than those already described, without departing from the basic principles of the inventions. For example, although all four described embodiments of the gas particle formation apparatus employ a circular or cylindrical structure, it will be obvious that the gas prefilming surface may be any shape, for example, planar by being formed on a flat vane or blade, or a plurality of such vanes or blades, the circular configuration being preferable because of its compact construction. Furthermore, it will be apparent to the skilled addressee that the gas particle formation apparatus of the invention can be employed in many other types of flotation apparatus, and indeed many other applications where efficient aeration of a liquid media is required. All such variations and modifications are to be considered within the scope of the present invention, the nature of which is to be determined from the foregoing description and appended claims.

I claim:

1. A method of gas particle formation in a liquid medium comprising the steps of:

forming a substantially continuous flowing film of gas on a surface having a discharge edge submerged in said liquid medium;

generating a first flow of liquid over said surface, adjacent to and co-current with said film of gas, directed towards said discharge edge;

generating a second flow of liquid which converges with said first flow from the opposite side of said film of gas at said discharge edge; and breaking the gas film into gas particles by shear forces as it approaches and/or escapes from said discharge edge.

2. A method of gas particle formation as claimed in claim 1, wherein the first and second liquid flows have dissimilar velocities.

3. A method of gas particle formation as claimed in claim 2, wherein the first and second liquid flows are accelerated towards the discharge edge of the surface together with the gas film.

4. A method of gas particle formation as claimed in claim 3, wherein the velocity of the first liquid flow is in the range 1.5 to 12 m/s and the velocity of the gas film is a finite amount up to 340 m/s.

5. An apparatus for gas particle formation, the apparatus comprising:

a structure having a surface with a discharge edge and having gas prefilming means for forming a substantially continuous flowing film of gas on said surface when submerged in a liquid medium;

means for generating a first flow of liquid over said surface, adjacent to and co-current with said film of gas, and directed towards said discharge edge; and means for generating a second flow of liquid which converges with said first flow from the opposite side of said film of gas at said discharge edge so that the gas film is broken into gas particles by shear forces as it approaches and/or escapes from said discharge edge.

6. An apparatus for gas particle formation as claimed in claim 5, wherein said discharge edge is in the form of a lip, and wherein said said first flow of liquid over said surface can converge with said second flow of liquid at said lip.

7. An apparatus for gas particle formation as claimed in claim 6, wherein said structure comprises a prefilming body of circular configuration having a circumferential edge flared outwardly defining an annular lip at one end, an outer surface of said body being adapted to form said film of gas thereon.

8. An apparatus for gas particle formation as claimed in claim 7, wherein said prefilming body is housed in a chamber having a liquid inlet and having an outlet in the form of a circular aperture with an outer escape diameter slightly larger than an outer diameter of said annular lip, said body being located with said annular lip proximate the circular aperture to form an annular gap.

9. An apparatus for gas particle formation as claimed in claim 8, wherein said prefilming body is provided with gas distribution outlets for delivering gas onto said outer surface on which, in use, said film of gas is formed, said distribution outlets being covered by a self-sealing resilient material.

10. An apparatus for gas particle formation as claimed in claim 9, further comprising means for changing the position of the annular lip relative to the circular aperture to vary the size of the annular gap whereby, in use, the size of the gas particles produced can be varied.

11. A flotation apparatus comprising an elongate riser having an aeration unit for aerating a cocurrent flow of gas/slurry mixture rising upwards in the riser, the aeration unit having an inlet and an outlet and including a structure having a surface, said surface having a discharge edge;

gas prefilming means for forming on said surface a substantially continuous flowing film of gas;

means for generating a first flow of slurry over said surface, adjacent to and co-current with said film of gas, and directed towards said discharge edge;

means for generating a second flow of slurry which converges with said first flow from the opposite side of said film of gas at said discharge edge so that the gas film is broken into gas particles by shear forces as it approaches and/or escapes from said edge; and means for generating substantially turbulence-free flow in which a high gas lift occurs in said riser such that a pressure drop between the inlet and the outlet of the aeration unit is sufficient to produce gas particle dispersion.

12. A flotation apparatus as claimed in claim 11, further comprising a reactor vessel provided between the aeration unit and the riser, said reactor vessel having a larger cross-sectional area than said riser and means for facilitating uniform gas dispersion and minimizing recombination of gas particles in a gas/slurry mixture formed therein.

13. A flotation apparatus as claimed in claim 12, wherein the riser has a flared end section at its upper end adapted to further slow down the flow of the gas/slurry mixture rising in the riser whereby, in use, the mixture slows down sufficiently for gas particles in the form of froth to separate from the slurry liquid at a discharge mouth of the riser.

14. A flotation apparatus as claimed in claim 13, wherein said riser discharges into a separation unit of the apparatus, and wherein said apparatus also comprises means for recirculating the slurry liquid recovered from the separation through the aeration unit to increase the probability of values attachment to the gas particles.

* * * * *

UNITED STATES PATENT AND TRADEMARK OFFICE

CERTIFICATE OF CORRECTION

PATENT NO. : 5,591,328

DATED : January 7, 1997

INVENTOR(S) : George Bodnaras

It is certified that error appears in the above—identified patent and that said Letters Patent is hereby corrected as shown below:

Column 1, line 3, delete "no", insert -- to --.

Column 4, line 3, delete "cheer", insert -- chamber --.

Column 4, line 12, delete "cheer", insert -- chamber --.

Column 4, line 56, delete "With", insert -- with --.

Column 6, line 23, delete "cheer", insert -- chamber --.

Column 6, line 35, delete "cheer", insert -- chamber --.

Column 7, line 8, delete "cheer", insert -- chamber --.

Column 7, line 18, delete "cheer", insert -- chamber --.

Column 7, line 42, delete "than", insert -- that --.

Column 8, line 13, delete "life", insert -- lift --.

Signed and Sealed this

Twenty-fifth Day of March, 1997

Bruce Lehman

*Attest:*

BRUCE LEHMAN

*Attesting Officer*

*Commissioner of Patents and Trademarks*